United States Patent [19]

Tachi et al.

[11] Patent Number: 4,792,094

[45] Date of Patent: Dec. 20, 1988

[54] ROTATING SPRAYING TYPE COATING APPARATUS

[75] Inventors: Kazuyuki Tachi; Chikaaki Okuda; Katsunori Yamada; Yoichi Oyama; Shoichi Suzuki, all of Aichi, Japan

[73] Assignee: Kabushiki Kaisha Toyota Chuo Kenkyusho, Aichi, Japan

[21] Appl. No.: 900,413

[22] Filed: Aug. 26, 1986

[30] Foreign Application Priority Data

Aug. 26, 1985 [JP] Japan ..... 60-187980
Dec. 25, 1985 [JP] Japan ..... 60-200150[U]

[51] Int. Cl.[4] ..... B05B 5/04

[52] U.S. Cl. ..... 239/106; 239/214.11; 239/222; 239/224; 239/300

[58] Field of Search ..... 239/223, 224, 222, 214.11, 239/700–703, 705–707, 106, 290, , 296, 300

[56] References Cited

U.S. PATENT DOCUMENTS

| | | | |
|---|---|---|---|
| 3,342,418 | 9/1967 | Wallis | 239/296 |
| 4,275,838 | 6/1981 | Fangmeyer | 239/223 |
| 4,422,576 | 12/1983 | Saito et al. | 239/703 X |
| 4,478,370 | 10/1984 | Hastings | 239/296 X |
| 4,519,549 | 5/1985 | Yokoe et al. | 239/702 X |
| 4,545,536 | 10/1985 | Avidon . | |
| 4,572,437 | 2/1986 | Huber et al. | 239/223 X |
| 4,605,168 | 8/1986 | Tachi et al. | 239/223 X |

FOREIGN PATENT DOCUMENTS

| | | | |
|---|---|---|---|
| 0142377 | 5/1985 | European Pat. Off. . | |
| 279775 | 3/1970 | Fed. Rep. of Germany . | |
| 2569580 | 3/1986 | France . | |
| 54-25270 | 2/1979 | Japan . | |
| 57-180460 | 11/1982 | Japan . | |
| 59-127761 | 8/1984 | Japan . | |
| 804805 | 11/1958 | United Kingdom | 239/700 |

*Primary Examiner*—Andres Kashnikow
*Attorney, Agent, or Firm*—Oblon, Fisher, Spivak, McClelland & Maier

[57] ABSTRACT

A rotating spraying type coating apparatus which includes a rotating drive device having a rotary shaft, a spraying head attached to the rotating drive device, a paint supplying passage connected to the base end of the spraying head, a paint radiating part formed at the top end of the spraying head, and at least one pair of air jetting holes provided on both sides of the spraying head. Also provided is a wash shroud for collecting washing agent radiated from the paint radiating part of the spraying head. This apparatus can provide a wide variety of coating patterns.

5 Claims, 12 Drawing Sheets

AIR FLOW RATE 0ℓ/min

FIRST AIR FLOW RATE 200ℓ/min
SECOND AIR FLOW RATE 0ℓ/min

FIRST AIR FLOW RATE 0ℓ/min
SECOND AIR FLOW RATE 300ℓ/min

FIRST AIR FLOW RATE 200ℓ/min
SECOND AIR FLOW RATE 300ℓ/min

ROTATING SPRAYING TYPE COATING APPARATUS

BACKGROUND OF THE INVENTION

1. Field of the Invention

This invention relates to a rotating spraying type coating apparatus capable of providing a variety of coating patterns.

2. Description of the Prior Art

In a conventional rotating spraying type coating apparatus, a cylindrical or bell-shaped spraying head is attached to the rotary shaft of a rotating drive device, a paint supplying passage is connected to the base end of the spraying head, a paint radiating part is formed at the top end of the spraying head, and air jetting holes for jetting a flow of air to bend forwardly the direction of the paint particles radiated from the paint radiating part are arranged in the form of a circular ring. The coating pattern is changed by controlling (increasing or decreasing) the flow rate of air jetted from the air jetting holes.

However, even if the flow rate of air is greatly changed (0 to 500 1/min), the coating pattern remains annular (like a doughnut), and the width of the coating pattern is not greatly changed. That is, with the conventional coating apparatus, the range of adjustment of the coating pattern is small, and it is impossible to provide an elliptic or dumbbell-shaped coating pattern.

In order to vary the coating pattern, a rotating spraying type coating apparatus has been proposed in which a number of air jetting holes are provided at the outside portion of the spraying head, and the air jetted from the air jetting holes are directed towards the periphery of the spraying head (Japanese Laid-Open Utility Model Publication No. 25270/1979). The conventional coating apparatus is intended to control the velocity and the width of the air flow formed forwardly of the outer circumferential wall of the spraying head in the circumferential direction of the spraying head thereby to control the scattering of the paint particles radiated from the spraying head. However, when the paint particles are radiated from the spraying head, it is considereably difficult because of the following reasons to control the scattering direction of the paint particles with the above-described air flow:

(1) The paint particles have relatively large kinetic energy. Therefore, in order to change the flying direction (or scattering direction) thereof, it is necessary to form an air flow large in velocity or in width.

(2) In order to cover all the paint particles scattered from the spraying head with the air flow satisfying the above-described condition (1), it is necessary to jet a considerably large quantity of air.

(3) The circle formed by the air jetting holes is large in diameter. Therefore, the coating apparatus is necessarily bulky and heavy.

(4) Some of the paint particles radiated from the spraying head stick to the parts adjacent to the air jetting holes, thus causing spitting. In order to eliminate this difficulty, it is necessary to position the air jetting holes at the rear of the spraying head, which makes it necessary to jet a large quantity of air for controlling the coating pattern.

On the other hand, in order to form an elliptic coating pattern, a rotating spraying type coating apparatus has been proposed which comprises; a number of first air jetting holes arranged in the form of a circle; and second air jetting holes for jetting air flows to bend the air flows jetted from the first air jetting holes (Japanese Laid-Open Patent Publication No. 180460/1982 and Japanese Laid-Open Utility Model Publication No. 127762/1984). In the conventional coating apparatus, the annular air flow formed forwardly of the spraying head is caused to collide with another air flow so that the velocity and the width of the air flows are controlled in the circumferential direction of the spraying head, whereby the scattering of the paint particles sprayed radially from the spraying head is controlled. Thus, its fundamental technical concept is completely the same as that of the coating apparatus disclosed by Japanese Laid-Open Utility Model Publication No. 25270/1979. Accordingly, the coating apparatus has the same difficulties, being not practical.

On the other hand, a rotating spraying type coating apparatus with a wash shroud has been known in the art which comprises: an air motor; a bell-shaped spraying head serving also as an electrode and mounted on the rotary shaft of the air motor; a paint supplying passage connected to the base end of the spraying head; a paint radiating part formed at the top end of the spraying head; an air jetting device in annular form installed at the top end of the case of the air motor to jet an air flow towards the rear outside surface of the spraying head; and a wash shroud covering the outside of the spraying head and being movable forwardly and rearwardly to collect a washing agent injected to the spraying head during washing. At the time of coating, the wash shroud is set at the rearward position where the paint radiating part of the spraying head projects from an opening in the front end of the wash shroud; and at the time of washing, the wash shroud is disposed at the forward position where the paint radiating part of the spraying head is held within the wash shroud.

However, in the case of the coating apparatus thus contructed, even if the flow rate of air jetted from the air jetting device is greatly changed, 0 to 500 1/min, the coating pattern remains annular (like a doughnut), and the dimensions of the coating pattern are not greatly changed. That is, the range of adjustment of the coating pattern is small. It goes without saying that it is impossible for the conventional coating apparatus to provide relatively flat coating patterns such as for instance elliptic or dumbbell-shaped coating patterns.

If it is possible to obtain relatively flat coating patterns in addition to circular coating patterns such as annular or disc-shaped coating patterns, in coating a rectangular area with paint the amount of paint wasted is minimized, and the coating operation can be achieved with high efficiency.

SUMMARY OF THE INVENTION

An object of this invention is to provide a rotating spraying type coating apparatus having a wide range of adjustment of a coating pattern which can provide not only circular or annular coating patterns but also elliptic coating patterns and dumbbell-shaped coating patterns.

The present inventors have conducted intensive research on a coating pattern control method for a rotating spraying type coating apparatus, and reached the following conclusions:

(1) In order to control the coating pattern efficiently (with a small quantity of air), the paint particles should not be scattered radially from the spraying head. If this requirement is satisfied, the coating pattern can be controlled with ease, adhesion of the paint to the coating apparatus can be prevented, and no spitting is caused.

(2) In order to prevent the difficulty that the paint particles are radially scattered from the spraying head, it is essential to form a high-speed air flow near the paint radiating part of the spraying head.

(3) In the case when at least one pair of air jetting outlets provided on both sides of the spraying head jet air towards the outer cylindrical wall of the spraying head (whose diameter is increased towards the end, or decreased towards the end, or unchanged), high speed air flows are formed as shown in FIGS. 1, 2 and 3. Both sides of the spraying head mean portions outside the outer circumferential wall of the spraying head or outside the extended portion thereof toward the air turbo motor. That is, when the air jetted from one of the air jetting outlets strikes the outer cylindrical wall of the spraying head, it is caused to flow along the outer cylindrical wall and, at a middle region of the outer cylindrical wall, meets the air flow jetted from the other air jetting outlets, thus forming a sector-shaped air flow. In this operation, the key point resides in the high-speed air flows running along the outer cylindrical wall of the spraying head, and the sector-shaped high-speed air flow which the aforementioned high speed air flows form when meeting each other at the middle of the outer cylindrical wall of the spraying head. The former air flows prevents scattering of the paint particles which are radiated from the spraying head by the centrifugal force, thereby to delivery the paint particles near to the middle of the outer circumferential wall, while the latter air flow acts to spread in the form of a sector the paint particles delivered to the middle of the outer circumferential wall. As a result, elliptic coating patterns or dumbbell-shaped coating patterns are formed.

In the case where one and the same coating apparatus is used for a variety of paints, it is undesirable that the air jetting outlets, holes or openings, are arranged adjacent to the outer cylindrical wall of the spraying head. That is, when it is required to wash the spraying head in order to use a paint different in color from the previously used one, the air jetting outlets obstruct the washing of the spraying head; that is, the spraying head cannot be washed sufficiently. In this case, two paints different in color are mixed, thus providing unsatisfactory coats.

Another object of the invention is to provide a rotating spraying type coating apparatus with a wash shroud having a wide range of adjustment of a coating pattern in which the spraying head can be sufficiently washed.

The apparatus of the present invention is constructed as follows.

(1) In a rotating spraying type coating apparatus in which a spraying head is attached to the rotary shaft of a rotating drive device, a paint supplying passage is connected to the base end of the spraying head, and a paint radiating part is formed at the top end of the spraying head, to radiate paint particles; according to the invention, at least one pair of air jetting holes or openings are provided on both or opposite sides of the spraying head, respectively, so as to jet air towards the outer cylindrical wall of the spraying head. The prolongations of the central axes of the air jetting holes cross the outer cylindrical wall of the spraying head.

(2) In the coating apparatus, air jetting holes adapted to jet air forwardly are annularly provided outside the spraying head, to bend forwardly the paint particles radiated from the paint radiating part.

(3) In order to increase the range of adjustment of the coating pattern and to sufficiently clean the spraying head, in a rotating spraying type coating apparatus with a wash shroud, a pair of air jetting holes are provided for the wash shroud in such a manner that the air jetting holes are arranged on both sides of the spraying head to jet air towards the outer cylindrical wall of the spraying head during coating.

In the coating apparatus of paragraph (1) above, a pair of air jetting holes provided on both sides of the spraying head (ideally being arranged symmertical with respect to the central axis of the spraying head) jet air towards the outer cylindrical wall of the spraying head to form air flows which run along the outer cylindrical wall, and the air flows thus formed meet each other at the middle of the outer cylindrical wall of the spraying head to form a sector-shaped air flow (cf. FIGS. 1, 2 and 3). Therefore, the coating apparatus, unlike the conventional one, can form ellipic coating patterns or dumbbell-shaped coating patterns. That is, the coating apparatus of the invention allows for a wide range of adjustment of the coating pattern.

The air flows running along the outer cylindrical wall of the spraying head eliminate the difficulty that the paint particles radiated from the spraying head by the centrifugal force are scattered radially, and convey the paint particles near to the middle of the outer cylindrical wall of the spraying head, while the sector-shaped air flow acts to spread in the form of a sector the particles conveyed to the middle of the outer cylindrical wall.

In the coating apparatus of paragraph (2) above, the air jetted forwardly by the air jetting device forms an annular or circular air flow. The paint particles conveyed by the air flow thus formed form an annular or circular coating pattern. In the coating apparatus, at least one pair of air jetting holes are provided on both sides of the spraying head. Therefore, by changing the flow rates of air jetted from the air jetting holes, a large diameter annular coating pattern, a small diameter circular coating pattern, an elliptic coating pattern or a dumbbell-shaped coating pattern can be formed. Thus, the coating apparatus of paragraph (2) is larger in the range of adjustment of the coating pattern than the coating apparatus of paragraph (1).

In the coating apparatus of paragraph (3) above, a relatively flat coating pattern such as an elliptic or dumbbell-shaped coating pattern is formed by jetting air from a pair of air jetting holes or openings in the air jetting device. When no air is jetted from the air jetting holes, the resultant coating pattern is circular. That is, the coating apparatus can provide not only a relatively flat coating pattern but also a circular pattern. Accordingly, it can be said that the coating apparatus of paragraph (3) also has a wide range of coating pattern adjustment.

At the time of washing, the air jetting device including the air jetting holes is moved forwardly together with the wash shroud, so as to be set in front of the spraying head, and it will not obstruct the washing of the spraying head.

A more complete appreciation of the invention and many of the attendant advantages thereof will be readily obtained as the same becomes better understood by reference to the following detailed description when considered in connection with the accompanying drawings, wherein:

DESCRIPTION OF THE PREFERRED EMBODIMENTS

Typical embodiments of the invention will be described.

Figure 5:
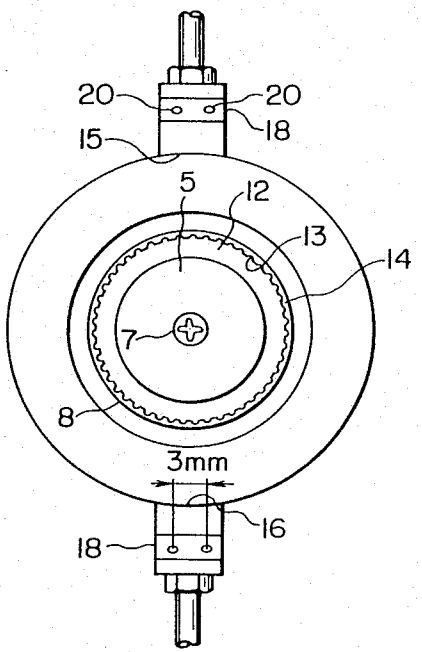
FIGS. 4 and 5 are a side view, with parts cut away, and a front view of a rotating spraying type coating apparatus according to a first embodiment of the invention, respectively.
Figure 3:
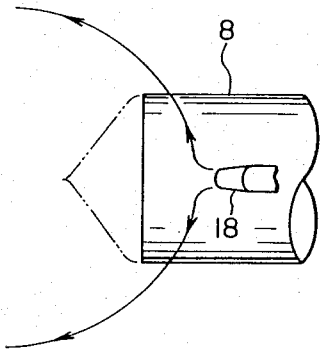
FIGS. 1 through 3 are explanatory diagrams outlining the fundamental air flows in rotating spraying type coating apparatuses provided according to this invention.
Figure 1:
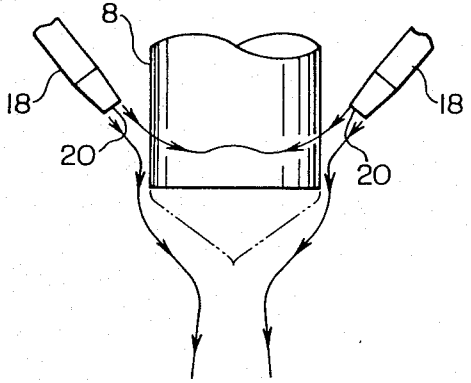
Figure 2:
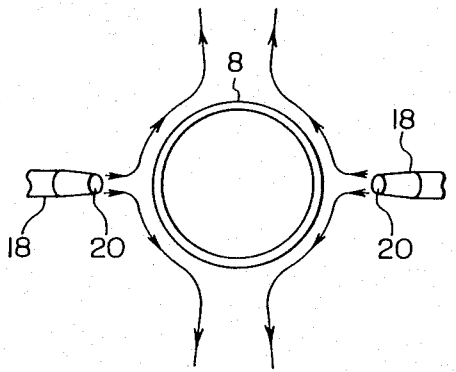
Figure 4:
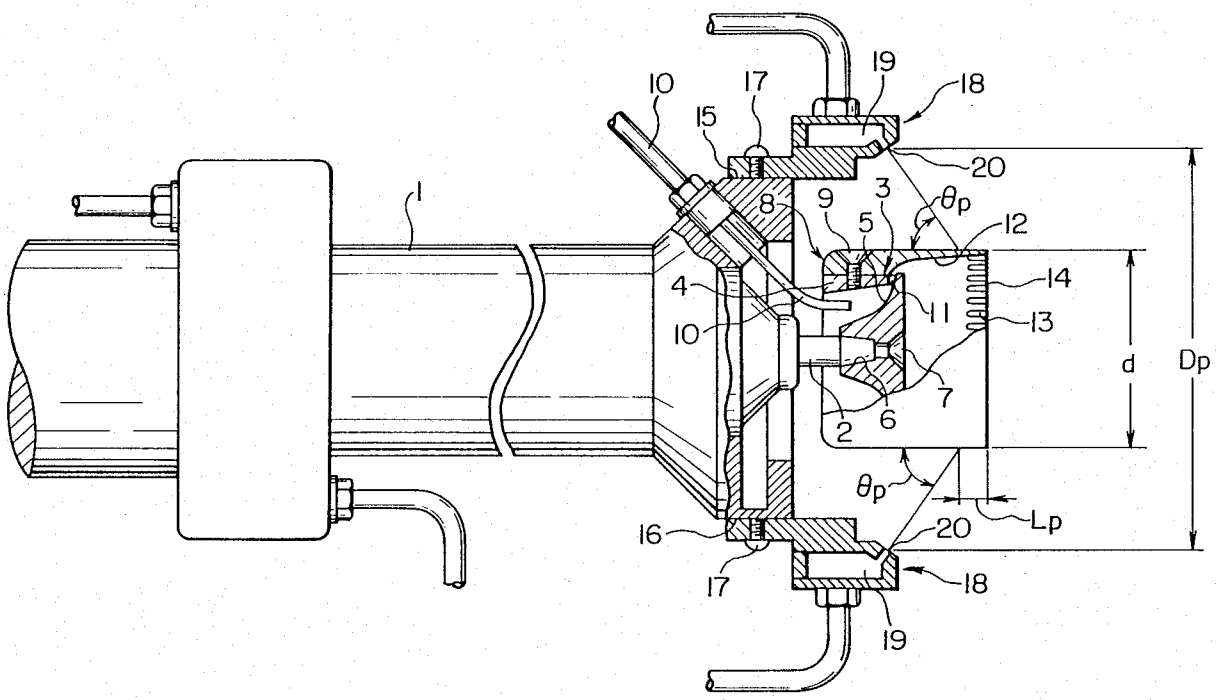

First Embodiment (FIGS. 4 and 5)

A rotating spraying type coating apparatus of a first embodiment of this invention, as shown in FIGS. 4 and 5, comprises: an air turbo motor 1 of a 60,000 rpm in maximum; a rotary shaft 2 projecting from the case top end of the air turbo motor 1; a hub 3 fitted to the rotary shaft 2 and including a cylinder portion 4 and a disc portion 5 connected coaxially to the top end of the cylinder portion 4; and a mounting hole 6 in taper form bored at the center of the disc portion 5 of the hub 3. The tapered top end of the rotary shaft 2 is fitted in the mounting hole 6, and the hub 3 is mounted coaxially on the rotary shaft 2 of the air turbo motor 1 with a screw 7 penetrating the center of the disc portion 5 of the hub 3. The rear half of a cylindrical member 8 is fitted on the hub 3 so that the front half of the cylindrical member 8 is protruded forwardly of the hub 3, and the cylindrical member 8 is coaxially attached to the hub 3 with screws 9 penetrating the wall of the cylindrical member 8. The hub 3 and the cylindrical member 8 thus put together form a spraying head. The spraying head (3 and 8) is connected through the air turbo motor 1 to a high DC voltage generating device (not shown), serving as an electrode.

A paint feed tube 10 connected to a paint supply device (not shown) is installed at the case top end of the air turbo motor 1, and an opening at the top end of the paint feed tube 10 is disposed within the cylinder portion 4 of the hub 3 of the spraying head, and the paint feed tube or passage 10 is connected to the hub 3 at the base end side of the spraying head. A number of paint passing holes 11 communicated with the inner front half of the cylindrical member 8 are bored at equal intervals in the circumferential wall of the end portion of the cylinder portion 4 of the hub 3, and the inner circumferential wall of the front half of the cylindrical member 8 is made a paint flowing surface 12. A number of paint splitting grooves 13 to prevent the mixing of air with paint are formed at equal intervals in the inner circumferential wall of the cylindrical member 8 in such a manner that they are extended in the axial direction so that an opening edge at the top end of the cylindrical member 8 is employed as a paint radiating part 14.

A pair of air jetting members 18 and 18 are secured to the upper surface 15 and the lower surface 16 of the case top end of the air turbo motor 1 with screws 17, respectively. Air passages 19 are formed in the pair of air jetting members 18 arranged outside of the spraying head (3 and 8). The air passages 19 are connected through flow rate adjusting valves (not shown) to a high-pressure air supplying device. Four air jetting holes 20 communicated with the air passages 19 (two being provided for each air passage 19) are formed in the inner wall of the front part of the air jetting members 18 positioned behind the paint radiating part 14 of the spraying head in such a manner that the prolongations of the central axes of the air jetting holes go across the outer circumferential surface of the spraying head and are symmetrical with respect to the central axis of the spraying head. The two air jetting holes 20 provided for each of the air jetting members 18 is spaced 3 mm from each other in the circumferential direction of the spraying head (3 and 8).

The number and the diameter of the air jetting holes 20 are four (4) and 1.8 mm, respectively. The sum of the opening areas of the air jetting holes 20 is practically not more than about 50 $mm^2$, and about 10 $mm^2$ in the above-described embodiment.

The angle $\theta_p$ between the prolongation of the central axis of each of the air jetting holes 20 and the outer circumferential wall of the spraying head is in a range of from 0° to 90°, 50° in the above-described embodiment. The distance Dp between the upper air jetting holes 20 and the lower air jetting holes 20 is practically defined by $4d \geqq Dp$, 50 mm in the embodiment. The outside diameter of d of the spraying head, i.e., the paint radiating part is 37 mm. The spraying head (3 and 8) may be so shaped that the top end portion is large in diameter or smaller in diameter of the spraying head is unchanged in diameter; that is, it is preferable that the angle between the outer circumferential wall of the spraying head and the axis of the spraying head is in the range of +45° to −45°, 0° in the embodiment.

When the rotating spraying type coating apparatus thus constructed is started, the spraying head is rotated at high speed, and DC high voltage is applied across the spraying head serving as an electrode and an article to be coated (not shown) which is arranged in front of the sprying head. High pressure air is supplied to the air passages 19 and jetted forwardly from the air jetting holes 20, while the paint is supplied from the paint supplying passage 10 into the hub 3 of the spraying head. The paint supplied into the hub of the spraying head rotating passes through a number of paint passing holes 11 to the inner front half of the cylindrical member 8, and flows in a film stage on the paint flowing surface 12. The paint further flows into a number of paint splitting grooves 13. As a result, the paint is separated into a number of filament-like streams to be radiated in the radial directions from the paint radiating part 14. In this operation, the paint particles radiated from the paint radiating part 14 are carried by the high-speed air flow which is formed along the outer circumferential wall of the spraying head (3 and 8) by the air which are jetted from two pairs of upper and lower air jetting holes 20 towards the outer circumferential wall of the spraying head. So the paint particles are collected near the middle part of the outer circumferential wall of the spraying head. The paint particles thus collected are spread in the form of a sector by the sector-shaped air flow which is formed when the above-described high-speed air flows formed along the outer circumferential wall of the sparying head collide at the middle part of the spraying head, and are caused to fly to the article to be painted by the force of the air flow jetted and an electrostatic attractive force acting between the paint particles and the article.

Figure 6:
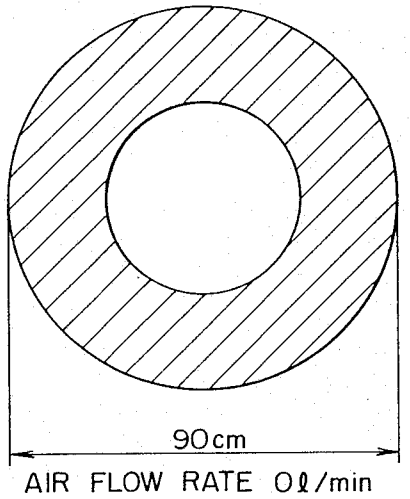
FIGS. 6 and 7 are explanatory diagrams showing examples of a coating pattern provided by the coating apparatus of the first embodiment.
Figure 7:
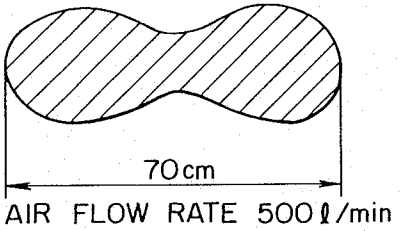

In the case of the above-described rotating spraying type coating apparatus, the relationships between the air flow rates and the coating patterns are as shown in FIGS. 6 and 7. When the air flow rate was 0 1/min, the coating pattern was like a ring having a width of about 90 cm. When the air flow rate was 500 1/min, the coating patterns was like a dumb-bell having a width of aobut 70 cm. In both cases, no paint particles adhered to the coating apparatus.

Figure 9:
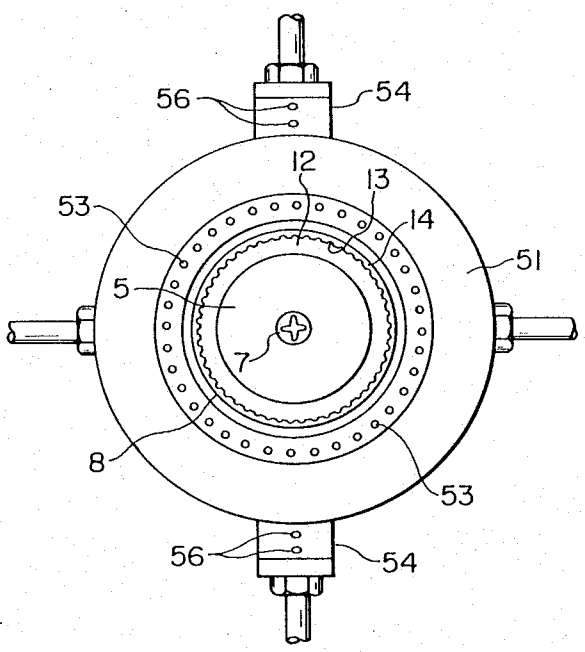
FIGS. 8 and 9 are side view, with parts cut away, and a front view of a rotating spraying type coating apparatus according to a second embodiment of the invention, respectively.
Figure 8:
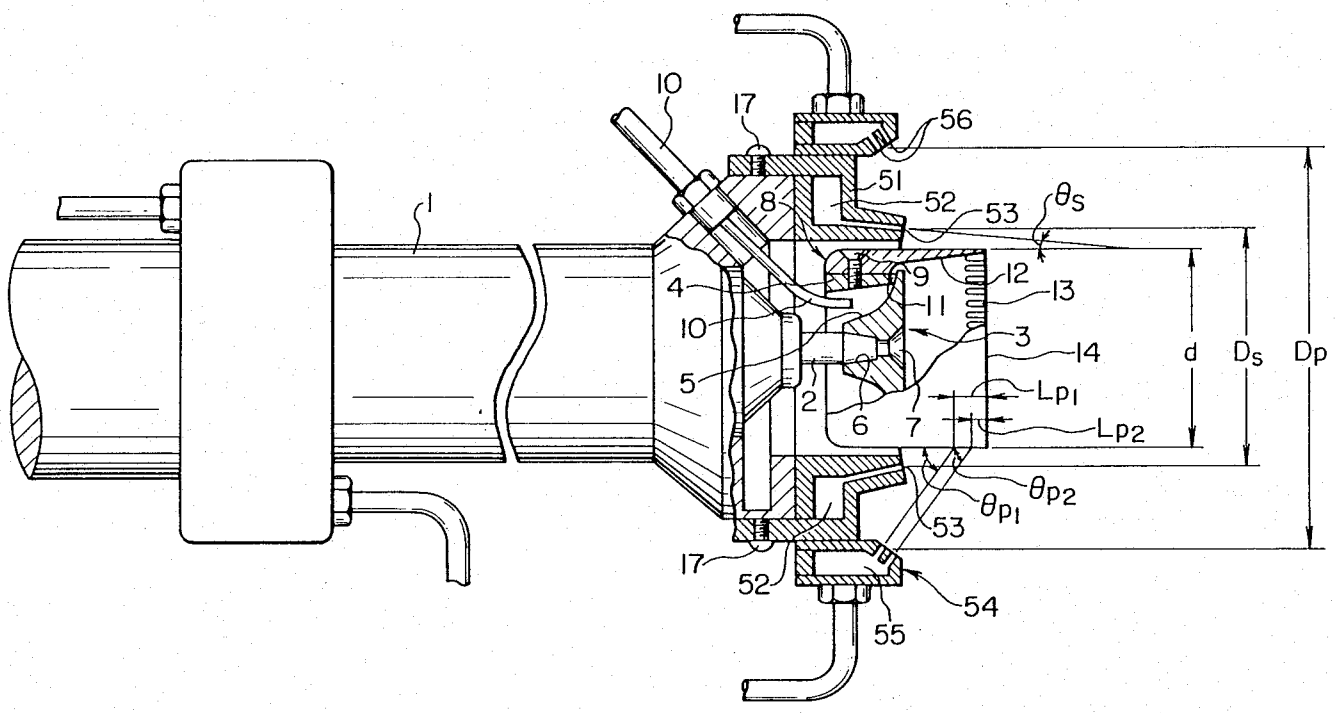

Second Embodiment (cf. FIGS. 8 and 9)

A rotating spraying type coating apparatus of a second embodiment of the invention, as shown in FIGS. 8 and 9, comprises; an air turbo motor 1 whose maximum speed is 60,000 rpm; a rotary shaft 2 projecting from the case top end of the air turbo motor 1; a hub 3 fitted to the rotary shaft 2 and including a cylinder portion 4 and a disc portion 5 connected coaxially to the top end of the cylinder portion 4; and a mounting hole 6 in taper form bored at the center of the disc portion 5 of the hub 3. The tapered top end of the rotary shaft 2 is fitted in the mounting hole 6, and the hub 3 is mounted coaxially on the rotary shaft 2 of the air turbo motor 1 with a screw 7 penetrating the center of the disc portion 5 of the hub 3. The rear half of a cylindrical member 8 is fitted on the hub 3 so that the front half of the cylindrical member 8 is protruded forwardly of the hub 3, and the cylindrical member 8 is coaxially attached to the hub 3 with a screw 9 penetrating the wall of the cylindrical member 8. The hub 3 and the cylindrical member 8 thus put together form a spraying head. The spraying head (3 and 8) is connected through the air turbo motor 1 to a high DC voltage generating device (not shown), serving as an electrode.

A paint feed tube 10 connected to a paint supply device (not shown) is installed at the case top end of the air turbo motor 1, and an opening at the top end of the paint feed tube 10 is disposed within the cylinder portion 4 of the hub 3 of the spraying head, and the paint feed tube or passage 10 is connected to the hub 3 at the base end side of the spraying head. A number of paint passing holes 11 communicated with the front half of the cylindrical member 8 are bored at equal intervals in the circumferential wall of the end portion of the cylinder portion 4 of the hub 3, and the inner circumferential wall of the front half of the cylindrical member 8 serves as a paint flowing surface 12. A number of paint splitting grooves 13 to prevent the mixing of air with the paint are formed at equal intervals in the inner circumferential wall of the cylindrical member 8 in such a manner that they are extended in the axial direction, so that an opening edge of the top end of the cylindrical member 8 is employed as a paint radiating part 14.

At the case end of the air turbo motor 1, an annular member 51 made of insulation material is attached to the spraying head (3 and 8) in such a manner that a ring-shaped first air passage 52 is formed around the spraying head. A high-pressure air supplying device is connected through a flow rate control valve (not shown) to the side of the first air passage 52. A number of first air jetting holes 53 are bored at equal intervals in the front surface of the annular member 51 located behind the paint radiating part 14 of the spraying head in such a manner that the first air jetting holes 53 are communicated with air jetting means, namely, the aforementioned first air passage 52, and are equidistant from the central axis of the spraying head.

A pair of second air jetting members 54 are secured to the upper end portion and the lower end portion of the annular member 51 with screws, respectively, so that a second air passage 55 is formed in the pair of second air jetting members 54 provided outside the annular member 51. Each of the second air passage 55 is connected through a flow rate control valve (not shown) to the high pressure air supplying device. Two second air jetting holes 56 are bored in the inner circumferential wall of the front part of each of the second air jetting members 54 located behind the paint radiating part 14 of the spraying head, in such a manner that the prolongations of the central axes of the holes 56 come across the outer circumferential wall of the spraying head (3 and 8) and the two air jetting holes 56 of the upper second air jetting member 54 and the two air jetting holes 56 of the lower second air jetting member 54 are symmetrically located with respect to the central axis of the spraying head.

The two second air jettng holes 56 of each of the second air jetting member 54 is spaced 5 mm from each other in the axial direction of the spraying head.

The diameter and the number of the first air jetting holes 53 are 0.6 mm, and thirty-three (33). The sum of the opening areas of the first air jetting holes 53 is about 40 $mm^2$ or smaller, about 10 $mm^2$ in the second embodiment described above. The distance $l_s$ between the opening of each of the first air jetting holes 53 and the paint radiating part 14 is 20 mm. The angle $\theta_s$ between the prolongation of the central axis of each of the air jetting holes 53 and the outer circumferential wall (or its extension) of the spraying head should meet $0° \leqq \theta_s < \theta 90°$, 10° in the embodiment. The center diameter Ds of the first air jetting holes 53 arranged coaxially with the spraying head is 44 mm. The outside diameter of the spraying head, i.e., the outside diameter d of the paint radiating part 14 is 37 mm.

The number and the diameter of the second air jetting holes 56 are four and 1.4 mm, respectively. The sum of the opening areas of the second air jetting holes 56 is about 6 $mm^2$. The angle $\theta_{p1}$ and $\theta_{p2}$ formed between the outer circumferential wall of the spraying head (3 and 8) and the prolongations of the central axes of the upper or lower second air jetting holes 56 are both 70°. The distance $L_{p1}$ and $L_{p2}$ between the paint radiating part 14 and the intersections of the prolongations of the central axes of the upper or lower second air jetting holes 56 with the outer cirumferential wall of the spraying head are 11 mm and 5 mm, respectively. The distance Dp between the uppermost second air jetting hole 56 and the lowermost second air jetting hole 56 of the annular member 51 is 80 mm.

When the rotating spraying type coating apparatus of the second embodiment is started, the spraying head is rotated at high speed, and DC high voltage is applied across the spraying head serving as the electrode and an article to be coated (not shown) which is disposed in front of the spraying head. High-pressure air is supplied to the air passages 52 and 55, and jetted forwardly from the air jetting holes 53 and 56, while the paint is supplied from the paint supplying passage 10 into the hub 3 of the spraying head. The paint supplied into the hub 3 of the spraying head is caused to pass through a number of paint passing holes 11 to the front half of the cylindrical member 8 by the centrifugal force, where the paint flows in a thin film state on the paint flowing surface 12. The paint further flows into a number of paint splitting grooves 13. As a result, the paint is separated into a number of filament-like streams to be radiated in the radial directions from the paint radiating part 14. In this operation, the paint particles radiated from the paint radiating part 14 are caused to fly over to the article by the force of the high speed air flows which are jetted forwardly along the paint radiating part from the first air jetting holes 53 and the second air jetting holes 56 and the electrostatic attractive force acting between the article and the paint particle.

The action and the effect of the air jetted from the second air jetting holes are substantially equal to those in the above-described first embodiment. The high speed air flow jetted forwardly along the paint radiating part 14 from the first air jetting holes 53 collects the paint radiated from the paint radiating part 14 on the prolongtion of the central axis of the spraying head.

Figure 10:
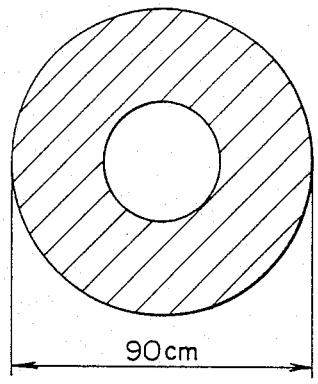
FIGS. 10 through 13 are explanatory diagrams showing examples of a coating pattern provided by the coating apparatus of the second embodiment.
Figure 11:
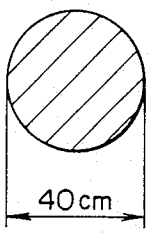
Figure 12:
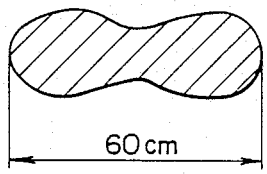
Figure 13:
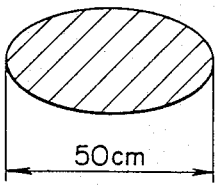

In the above-described rotating spraying type coating apparatus, the relationship between the rates of flow of air jetted from the first air jetting holes 53 and the second air jetting holes 56 (hereinafter referred to as "first air" and "second air", when applicable) and the coating patterns are as shown in FIGS. 10 through 13. When neither of the first and second air flows are jetted, the coating pattern is like a ring about 90 cm in width as shown in FIG. 10. When only the first air flow is jetted at a flow rate of 200N 1/min, the coating pattern is a solid circle about 40 cm in width, as shown in FIG. 11. When only the second air flow is jetted at a flow rate of 300N 1/min, the coating pattern is like a dumbbell about 60 cm in width as shown in FIG. 12. When the first air flows and the second air are jetted respectively at flow rates of 200 1/min and 300 1/min, the coating pattern is in the form of an ellipse about 50 cm in width as shown in FIG. 13.

As was described above, the specific feature of the coating apparatus of the second embodiment resides in that the coating pattern can be greatly changed by controlling the flow rates of the first and second air flows. In general as the flow rate of the second air flow increased, the coating pattern approaches an ellipse or dumbbell shape having a large width.

With respect to the sum Ss of the opening areas of the first air jetting holes 53 and the sum Sp of the opening areas of the second air jetting holes 56, it is desirable that the average speed of the air at the opening of each air jetting hole (i.e., (air flow rate)/(sum of opening areas Ss or Sp) exceeds the sound velocity. Furthermore, it is preferable that the flow rate $Q_1$ of the first air is to determined that $Q_1/d$ is 2.5 (1/mm·min) or larger.

In the case where at least two pairs of second air jetting holes are provided, the prolongations of the central axes of at least one pair of second air jetting holes should cross the outer circumferential wall of the spraying head, and the values $\theta p_i$ and $Lp_i$ ($i=1, 2, \ldots$) may be different.

Figure 15:
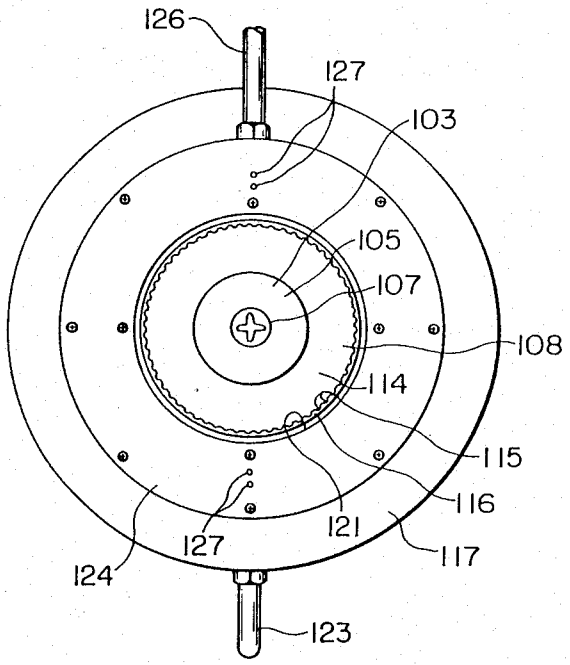
FIGS. 14 and 15 are a side view, with parts cut away, and a front view of a rotating spraying type coating apparatus with a wash shroud according to a third embodiment of the invention, respectively.
Figure 14:
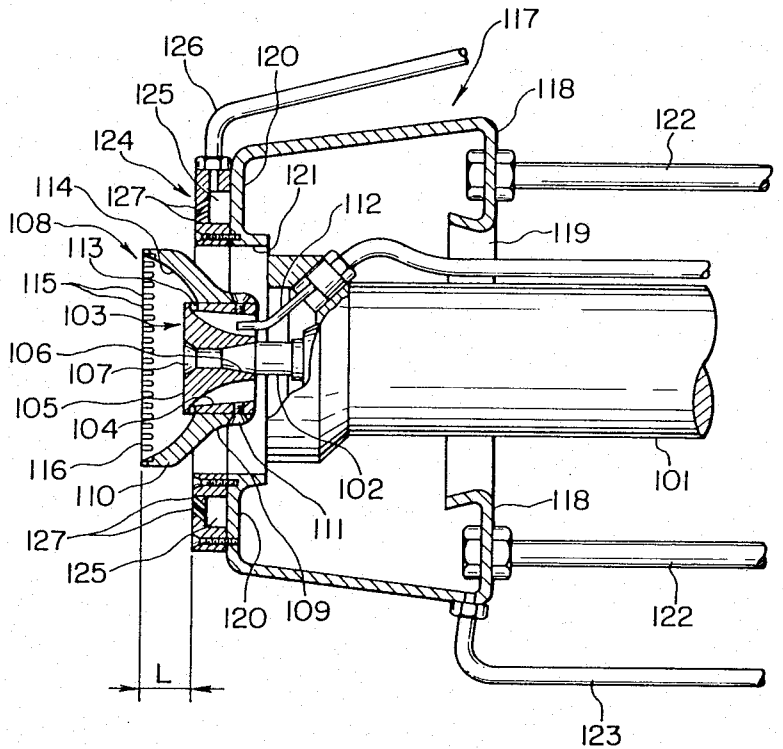
Figure 16:
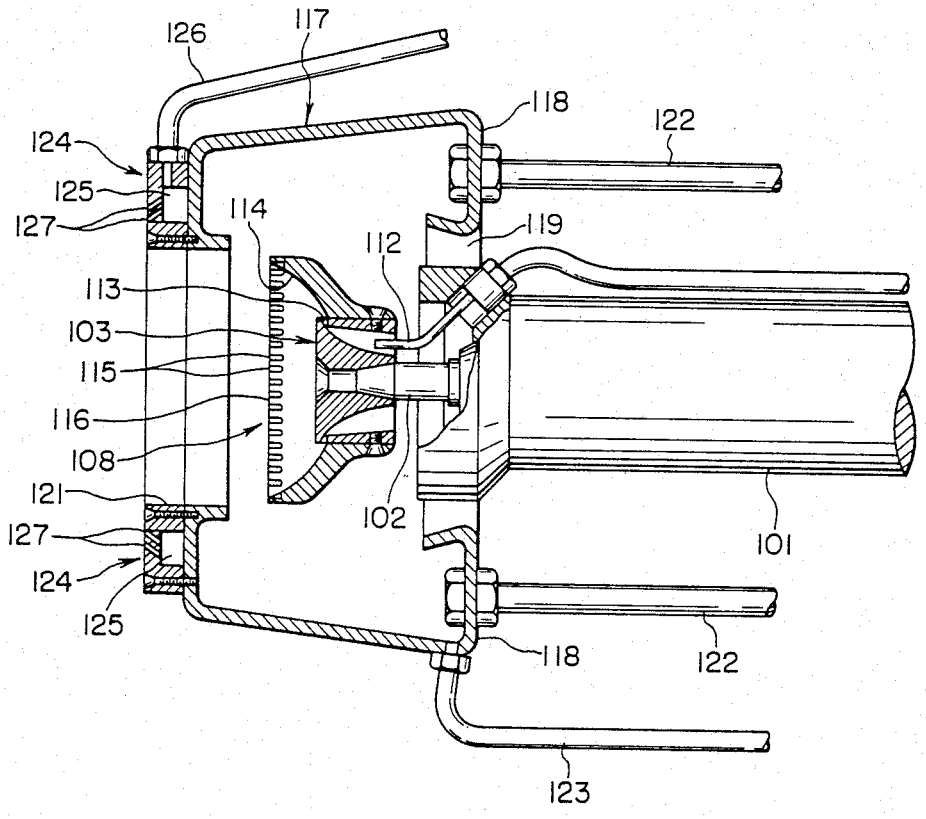
FIG. 16 is a side view, with parts cut away, showing a state of washing of the coating apparatus of the third embodiment.

Third Embodiment (cf. FIGS. 14 through 16)

A rotating spraying type coating apparatus with a wash shroud of a third embodiment of the invention is as shown in FIGS. 14 and 15. A wash shroud 117 in the form of a circular truncated cone is coaxially arranged outside of a spraying head (103 and 108) and outside of the top end portion of an air turbo motor 101. The wash shroud 117 is made of insulation material, and the top ends of drive shafts 122 made of insulation material of a reciprocation drive device (not shown) are connected to the end plate 118 in circular ring plate form of the wash shroud 117 so that the wash shroud 117 is movable forward and rearward. A washing agent suction passage 123 is connected to the lower portion of the circumferential wall of the wash shroud 117.

An air jetting device 124 is installed on the front surface of the annular-plate-shaped end plate 120 of the wash shroud 117, and has an annular air passage 125 formed coaxially with the spraying head (103 and 108). A high pressure air feed passage 126 is connected to the upper side of the air passage 125 through a flow control valve for adjusting the coating pattern. Two pairs of air jetting holes having a diameter of 1.8 mm, namely, the upper pair of air jetting holes 127 and the lower pair of air jetting holes 127 are formed in the front surface of the air passage 125 in such a manner that the upper and lower pair of air jetting holes 127 are located symmetrical with respect to the spraying head and obliquely directed towards the top end portion of the spraying head. Namely, the prolongation of the central axis of each of the air jetting holes 127 goes across the outer circumferential surface of the top end portion of the spraying head.

An opening 121 at the front end of the wash shroud 117 formed by the inner circumferential surface of the annular air jetting device 124 and the inner circumferential surface of the end plate 120 in circular ring plate form at the top end of the wash shroud 117 has a diameter slightly larger than the maximum outside diameter of the spraying head, and the opening 119 at the base end of the wash shroud 117 has a diameter even larger.

When coating is performed by driving the coating apparatus thus constructed, first the reciprocation drive device (not shown) is driven rearwardly, whereby the wash shroud 117 is moved rearwardly to the position where the paint radiating part 116 of the spraying head projects from the opening 121 at the front end of the wash shroud as shown in FIG. 14.

The distance L between the opening surface of the air jetting holes 127 of the air jetting device and the opening surface of the paint radiating part 116 of the spraying head is 20 mm.

Next, the spraying head is rotated at high speed, and a DC high voltage is applied accross the spraying head serving also as charging electrode and an article to be coated (not shown) arranged in front of the spraying head. High-pressure air is supplied to the air passage 125 of the air jetting device 124 and jetted forwardly from the air jetting holes 127, and the paint is supplied through the paint feed passage 112 into the hub 103 of the spraying head.

The paint supplied into the hub 103 of the spraying head rotating passes through a number of paint passing holes 113 by the centrifugal force and comes into the cup-shaped portion 110 of the bell-shaped body and further flows in the form of a thin film on the paint flowing surface 114 of the cup-shaped portion 110. The paint flows in a number of grooves 115 in the paint separating part, thus being separated into a number of filament-like streams which are radiated radially from the paint radiating part 116. That is, the atomization of paint in a filament forming mode has been effected. The paint particles radiated from the paint radiating part 116 of the spraying head fly to the article and adhere thereto with the flying direction bent forward by the force of the air flow in the form of a sector which is jetted forwardly along the outer circumferential wall of the top end portion of the spraying head from the air jetting holes 127 and the electrostatic attractive force acting between the article and the paint particles.

The coating pattern can be changed by controlling the flow rate of air supplied to the air passage 125, i.e., by increasing or decreasing the flow rate of air jetted from the air jetting holes 127.

The relationships between the configurations and dimensions of the coating patterns and the flow rates of air are substantially equal to those indicated in FIGS. 6 and 7. At any one of the flow rates, adhesion of the paint particles to the outside of the spraying head, the air jetting device 124 and the wash sround 117 has not been observed.

If the distance L between the opening surface of the air jetting holes 127 and the opening surface of the paint radiating part 116 is decreased, then the velocity of the air flow passing along the outside of the paint radiating part 116 is increased; however, the paint particles are liable to stick to the outer circumferential wall of the spraying head, the air jetting device 124, and the end portion of the wash shroud 117. Therefore, it is desirable that the distance L is set to 1 to 60 mm, preferably 5 to 30 mm.

When washing is performed by driving the abovedescribed coating apparatus, the reciprocation drive device (not shown) is driven forwardly, whereby the wash shroud 117 is moved forwardly to the position where the spraying head is arranged in the wash shroud 117 as shown in FIG. 16. Under this condition, thinner or air, i.e., the washing agent is injected through the paint supply passage 112 into the hub 103 of the spraying head rotating to which no DC high voltage is applied yet.

Similarly as in the case of the above-described paint application, the washing agent fed into the hub 103 of the spraying head rotating passes through the paint passing holes 113, the paint flowing surface 114 and the paint separating grooves 115, and is then radiated from the paint radiating part 116 by the centrifugal force, so as to wash the inner surface of the spraying head. The washing agent radiated from the paint radiating part 116 strike against the inner circumferential wall of the wash shroud 117 and is collected on the bottom of the base end portion of the wash shroud 117. The washing agent thus collected is discharged through the washing agent suction passage 123.

In the coating apparatus of the embodiment, since the air jetting device 124 is provided at the front end of the wash shroud 117, at the time of washing the wash shroud 117 is moved forwardly whereby the air jetting device 124 is disposed at the front side of the spraying head as shown in FIG. 16. Therefore, the air jetting device 124 will never obstruct the washing of the spraying head.

Figure 17:
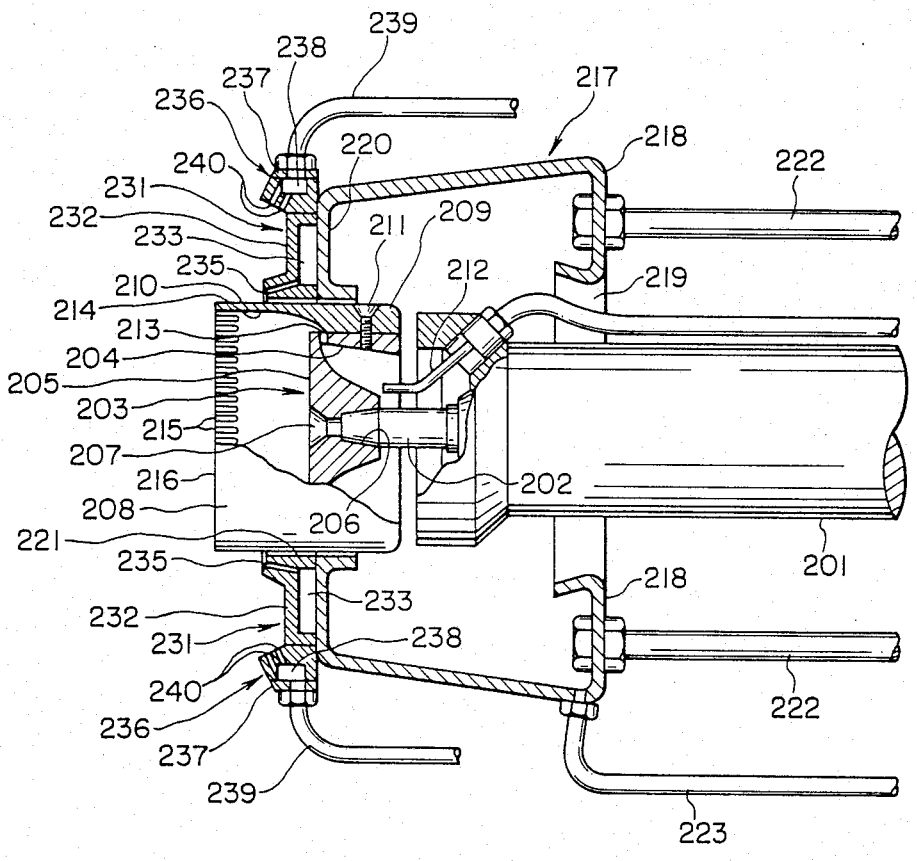
FIGS. 17 and 18 are a side view, with parts cut away, and a front view of a rotating spraying type coating apparatus with a wash shroud according to a fourth embodiment of the invention, respectively.
Figure 18:
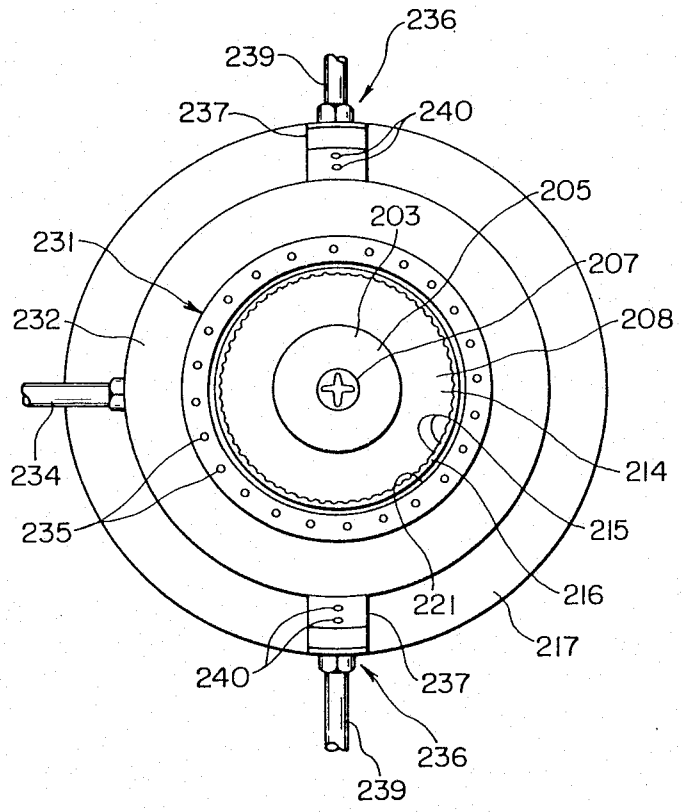

Fourth Embodiment (cf. FIGS. 17 and 18)

In a rotating spraying type coating apparatus with a wash shroud of a fourth embodiment, in comparison with the third embodiment, the bell-shaped part of the third embodiment is replaced by cylinder 208 having a rear half cylinder portion 209 and a front half cylinder portion 210 coaxially connected to form a spraying head 203 and 208, and the air jetting device 224 provided on the front surface of the annular-plate-shaped and plate 220 at the end of the wash shroud 117 in the third embodiment is replaced by first and second air jetting device 231 and 236.

The first air jetting device 231 is as shown in FIGS. 17 and 18. An annular member 232 is attached to the front surface of a circular-ring-shaped plate 220 at the end of the wash shroud 217 so that an annular air passage 233 is formed in the annular member 232 in such a manner that it is coaxial with the spraying head (203 and 208). A high-pressure supplying passage 234 is connected through a coating pattern adjusting flow rate control valve (not shown) to the air passage 233 in the annular member 232. Thirty-three air jetting holes 235 having a diameter of 0.6 mm are formed at equal intervals on the front surface of the air passage 233 in such a manner that they form a circle coaxial with the spraying head and are slightly inclined towards the center of the circle. The air is jetted forwardly along the end portion of the spraying head during coating from the air jetting holes 235 arranged in the form of a circle.

The second air jetting device 236 is also as shown in FIGS. 17 and 18. Blocks 237 are attached to the upper and lower portions of the annular member 232 of the first air jetting device, respectively, so that air passages 238 are formed in the block, respectively. High pressure air supplying passages 239 are connected through coating pattern adjusting flow rate control valves (not shown) to the air passages 238, respectively. A pair of air jetting holes 240 having a diameter of 1.4 mm are formed in the front part of the inside of each of the air passages 238. More specifically, two pairs of air jetting holes are located symmetrically with respect to the spraying head and directed towards the outer circumferential wall of the end portion of the spraying head at the time of coating. The two pairs of air jetting holes 240 correspond to the two pairs of air jetting holes 127 in the third embodiment.

The fourth embodiment is similar to the third embodiment except for the above-described difference, and in FIGS. 17 and 18 parts corresponding functionally to those already described with reference to FIGS. 14 and 15 are therefore designated by like reference numericals or characters.

The coating pattern can be changed by controlling the flow rate of air jetted from the air jetting holes 235 of the first air jetting device and the flow rate of air jetted from the air jetting holes 240 of the second air jetting device.

The relationships between the configurations and dimensions of the coating pattern and the flow rates of the first and second air flows are as indicated in FIGS. 10 through 13. As is apparent from these figures, the coating pattern approaches a small diameter disc as the flow rate of the first air is increased, and, as the flow rate of the second air flow is increased, the coating pattern shows a relatively elongated flat configuration.

Modifications

When, in the rotating spraying type coating apparatus of the second embodiment, the flow rates of the first and second air flows are changed by high-speed flow rate control devices, respectively, the coating pattern is changed instantaneously. Therefore, the coating apparatus is useful as an automatic coating apparatus or a robot-operated coating apparatus. Furtherfore, switching of the air flow rate and switching of the paint injection rate may be effected in association with each other to improve the utility of the coating apparatus.

The rotating spraying type coating apparatuses of the second and fourth embodiments are so designed that the first air and the second air are supplied separately; however, the apparatuses may be so designed that they are supplied together without separation.

Figure 19:
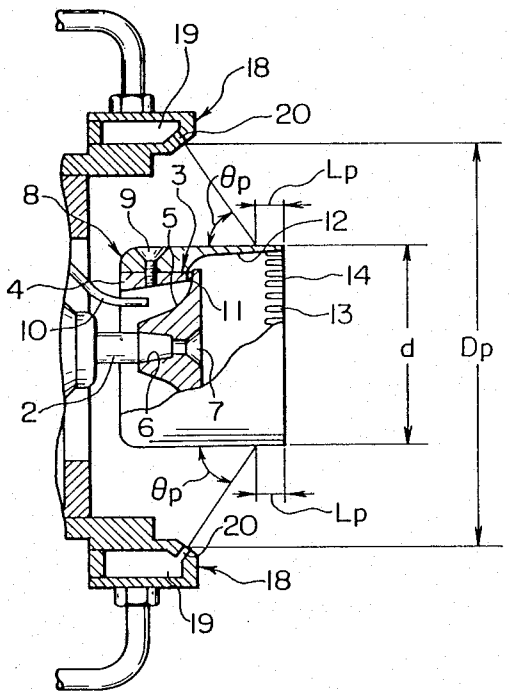
FIGS. 19 through 24 are diagrams showing modifications of the rotating spraying type coating apparatus according to the invention.
Figure 20:
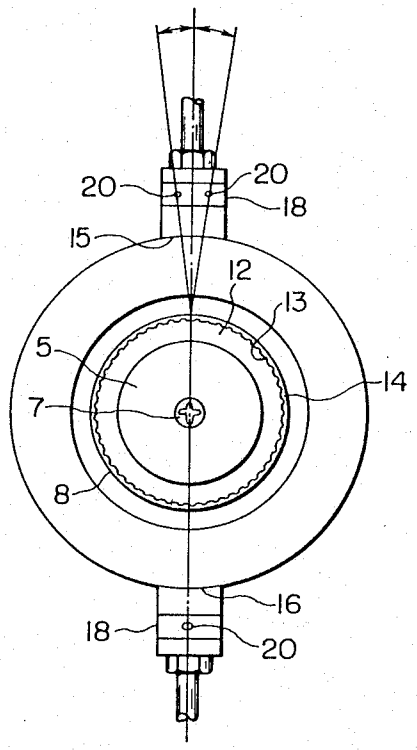

In the invention, the configuration of the spraying head, and the configuration, the number and the arrangement of the air jetting holes are not limited to those described in the embodiments. For example in the second embodiment, at least one annular slit type air jetting hole may be used in addition to a number of first air jetting holes. Further, the paint radiating part may be disposed at a portion other than the top end portion of the spraying head. For example, a number of holes as paint radiating holes may be penetrated at the side wall of the spraying head. For instance, in the rotating spraying type coating apparatus of the first embodiment, the air jetting holes 20 may be arranged as shown in FIGS. 19 and 20. A pair of air jetting memebers 18 are secured to the upper end surface 15 and the lower end surface 16 of the case end portion of the air turbo motor 1 with the screws (not shown), and air passages 19 are formed in the pair of air jetting members 18, respectively, and are connected through flow rate control valve (not shown) to a high-pressure air supplying device. Three air jetting holes 20 communicated with the air passages 19 (two for the upper air jetting member, and one for the lower air jetting member) are formed in the inner walls of the front parts of the air jetting members 18 positioned behind the paint radiating part 14 of the spraying head in such a manner that the prolongations of the central axes of the air jetting holes cross the outer circumferential wall of the spraying head and are located substantially symmetrically with respect to the central axis of the spraying head. The two air jetting holes 20 bored in the upper air jetting member 18 on the upper end surface 15 are spaced 3 mm from each other in the circumferential direction of the spraying head. The prolongations of the central axes of the two air jetting holes cross at the intersection of the line connecting the central axis of the one air jetting hole 20 formed in the air jetting member 18 on the lower end surface 16 and the central axis of the spraying head and the outer circumferential wall of the spraying head.

The opening area of the one air jetting hole 20 formed in the air jetting member 18 on the lower end surface 16 is about 4.5 $mm^2$, and the sum of the opening areas of the two jetting holes 20 formed in the air jetting member 18 on the upper end surface 15 is about 5.1 $mm^2$; that is, the opening area of the one air jetting hole 20 formed in the lower air jetting member 18 is substantially equal to the sum of the opening areas of the two air jetting hole 20 formed in the upper air jetting member 18. The rotating spraying type coating apparatus thus constructed can provide substantially the same coating patterns as the coating apparatus of the first embodiment. In the case of the above-described modification, strictly stating, the air jetting holes are not symmetrical; however, the functions of the coating apparatus are substantially equal to those of the coating apparatus in which the air jetting holes are arranged symmetrical. That is, this invention covers the coating apparatus in which the air jetting holes are functionally symmetrically arranged.

Figure 21:
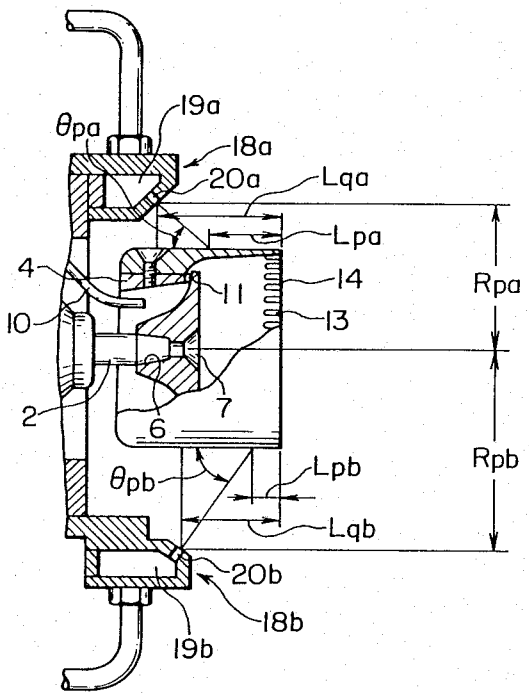
Figure 22:
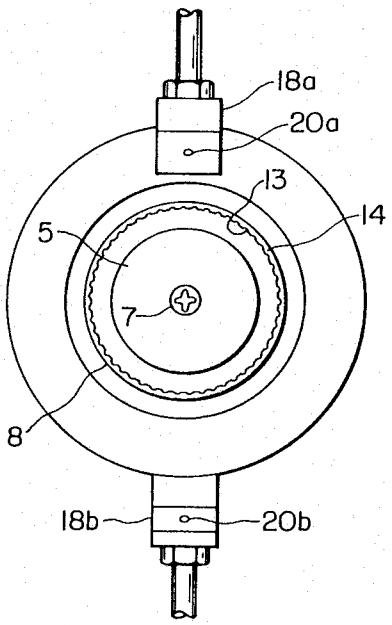

The rotating spraying type coating apparatus of the first embodiment may be so modified that the air jetting holes 20 are arranged asymmetrically as shown in FIGS. 21 and 22. The upper air jetting member **18*a* and the lower air jetting member 18*b* are secured to the upper end surface 15 and the lower end surface 16 of the case end portion of the air turbo motor 1 with screws (not shown), respectively. Air passages 19 are formed in the upper and lower air jetting members 18*a* and 18*b* thus secured, respectively, and are connected through air flow control valves (not shown) to a high-pressure air supplying device. Two air jetting holes 20*a* and 20*b* communicated with the air passages 19*a* and 19*b* in the inner walls of the front parts of the two air jetting members 18*a* and 18*b* positioned behing the paint radiating member 14 of the spraying head in such a manner that the prolongations of the central axes of the air jetting holes 20*a* and 20*b* cross the outer circumferential wall of the spraying head and are located asymmetrical with respect to the spraying head. More specifically, the angle $\theta pa$ between the prolongation of the central axis of the upper air jetting hole 20*a* and the outer circumferential wall of the spraying head (3, 8) is not equal to the angle $\theta pb$ between the prolongation of the central axis of the lower air jetting hole 20**b and the outer circumferential wall of the spraying head. In addition, the following relations are established:

$Lpa \neq Lpb$ $Lqa \neq Lqb$ $Rpa \neq Rpb$ where Lpa is the distance between the paint radiating part 14 and the intersection of the prolongation of the central axis of the upper air jetting hole **20*a* and the outer circumferential wall of the spraying head, Lpb is the distance between the paint radiating part 14 and the intersection of the prolongation of the central axis of the lower air jetting hole 20*b* and the outer circumferential wall of the spraying head, Lqa is the distance between the opening of the air jetting hole 20*a* and the paint radiating part 14, Lqb is the distance between the opening of the air jetting hole 20*b* and the paint radiating part 14, Rpa is the distance between the opening of the air jetting hole 20*a* and the central axis of the spraying head, and Rpb is the distance between the opening of the air jetting hole 20*b*** and the central axis of the spraying head.

With the rotating spraying type coating apparatus thus modified, the dumbbell-shaped coating pattern is somewhat distorted; however, it is still practical.

The rotating spraying type coating apparatus of the second embodiment may be so modified that all of the air jetting holes are arranged in the form of a circular ring, and some of the air jetting holes satisfy the following condition: That is, at least one pair of air jetting holes which are located substantially symmetrical with respect to the center of the circular ring have the central axes whose prolongations cross the outer circumferential wall of the spraying head.

Figure 23:
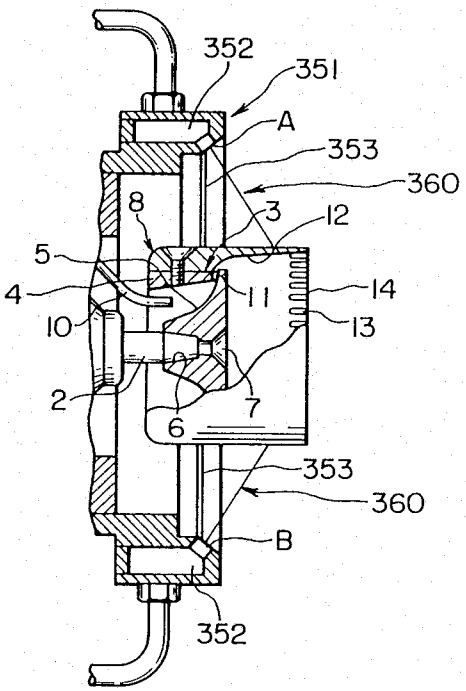
Figure 24:
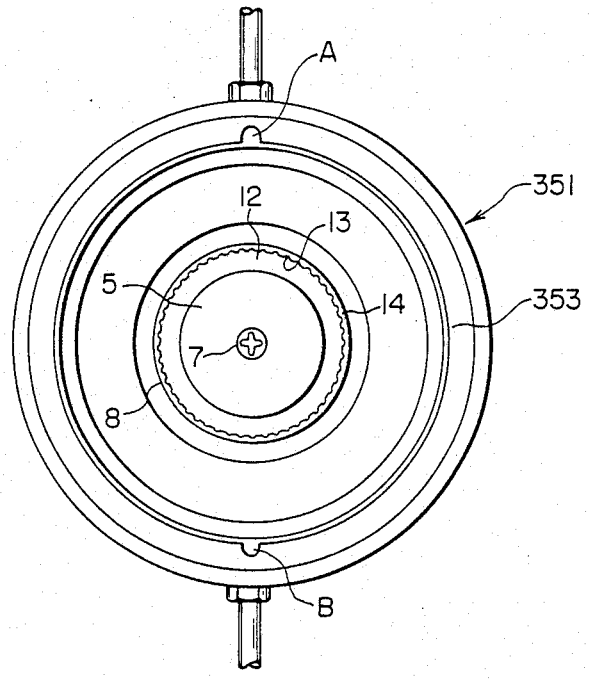

The air jetting holes may be arranged as shown in FIGS. 23 and 24. An annular member 351 is secured to the case end portion of the air turbo motor 1 so that an annular air passage 352 is formed in the annular member 351 provided at the outside portion of the spraying head. A high pressure air supplying device is connected through a flow rate control valve (not shown) to the air passage 352. An annular slit-like air jetting hole 353 communicated with the air passage 352 is formed in the front surface of the annular member 351 located behind the paint radiating part 14 of the spraying head in such a manner that the annular slit-like air jetting hole is coaxial with the spraying head. The opening width of the annular air jetting hole 353 is constant except for the upper and lower parts A and B; that is, the upper and lower parts A and B are larger in opening width than the remaining parts. The prolongations of the central axes of the upper and lower parts A and B cross the outer circumferential wall of the spraying head. The rotating spraying type coating apparatus thus modified can provide substantially the same coating patterns as the coating apparatus of the second embodiment. In the case of the above-described modification, strictly stating, the air jetting holes are not paired; however, the functions of the coating apparatus are substantially equal to those of the coating apparatus in which the air jetting holes are paired. That is, this invention covers the coating apparatus in which the air jetting holes are functionally paired. Furthermore, the application of the above-described embodiments is not limited to electrostatic coating apparatuses.

The coating efficiency of the coating apparatus of the invention is somewhat lower than that of the conventional rotating spraying type coating apparatus, but higher than that of an air spraying type coating apparatus.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A rotating spraying type coating apparatus, comprising:

a rotating drive device having a rotary shaft, a substantially cylindrical spraying head attached to the rotary shaft of said rotating drive device, said spraying head having a base end of the side of said rotary shaft and top end on the side of an article to be coated, a paint supplying passage connected to said spraying head, paint radiating means for radiating paint particles and mounted at the top end of said spraying head, and air jetting means comprising at least one pair of air jetting openings having a sufficiently small length between inner walls thereof, relative to the circumference length of the spraying head and provided on both sides of said spraying head, prolongations of central axes of said at least one pair of air jetting openings intersecting said outer circumferential wall of said spraying head at a predetermined angle, for jetting air locally on the outer circumferential wall of said spraying head and for spreading said locally jetted air in the circumferential direction along the whole outer circumferential wall to form air streams having a circumferential velocity component in addition to an axial velocity component, said axial velocity component being largest at the locally air-jetted portion on the outer circumferential wall and smaller at a portion farther therefrom and said circumferential velocity component being smallest at the locally air-jetted portion and the larger at a portion farther therefrom, so as to enable said air streams to wrap said paint particles as soon as said paint particles leave said spraying head and to form said paint particles into a coating pattern substantially of a dumbell or elongated shape composed of two portions joined together, each of said portions having a large axial velocity component and having a part with more paint particles than a remaining part therein.

2. A coating apparatus as claimed in claim 1, wherein said at least one pair of air jetting openings are located substantially symmetrical with respect to the central axis of said spraying head.

3. A coating apparatus as claimed in claim 1, further comprising at least one annular air jetting opening for jetting air, provided outside said spraying head so as to bend paint particles radiated from said paint radiating means.

4. A coating apparatus as claimed in claim 1, further comprising a wash shroud for collecting washing agent radiated from said paint radiating means mounted on said spraying head arranged around said spraying head in such a manner that said wash shroud is movable in first and second opposite directions so that said wash shroud is set at first position at the time of coating where said paint radiating means mounted on said spraying head is protruded from a front end opening of said wash shroud and at a second position at the time of washing where said paint radiating means mounted on said spraying head is disposed within said wash shroud, wherein said at least one pair of air jetting openings are provided on opposite sides of an end portion of said wash shroud.

5. A coating apparatus as claimed in claim 4, further comprising at least one annularly provided air jetting opening for jetting air in said first direction, provided outside said spring head so as to bend paint particles radiated from said paint radiating means.

* * * * *